US006494753B1

(12) United States Patent
Tomasino

(10) Patent No.: US 6,494,753 B1
(45) **Date of Patent: *Dec. 17, 2002**

(54) NO-CRIMP ELECTRICAL CONNECTOR SIDE-BY-SIDE TYPE AND METHOD

(75) Inventor: René Tomasino, Poplar Bluff, MO (US)

(73) Assignee: Swenco Products, Inc., Poplar Bluff, MO (US)

( * ) Notice: Subject to any disclaimer, the term of this patent is extended or adjusted under 35 U.S.C. 154(b) by 11 days.

This patent is subject to a terminal disclaimer.

(21) Appl. No.: 09/939,721

(22) Filed: Aug. 28, 2001

Related U.S. Application Data

(63) Continuation-in-part of application No. 09/617,231, filed on Jul. 14, 2000.
(60) Provisional application No. 60/146,344, filed on Aug. 2, 1999.

(51) Int. Cl.[7] ..... H01R 11/03
(52) U.S. Cl. ..... 439/791; 439/845
(58) Field of Search ..... 439/291, 805, 439/727, 845, 931; 124/87, 86, 88, 89, 90; 24/136 B; 285/334.4; 219/541; 350/96.2

(56) References Cited

U.S. PATENT DOCUMENTS

| | | | | |
|---|---|---|---|---|
| 939,501 | A | | 11/1909 | Hinds |
| 1,751,572 | A | | 3/1930 | Beemer |
| 1,941,715 | A | | 1/1934 | Pfisterer |
| 2,001,131 | A | | 5/1935 | Guhl |
| 2,064,440 | A | | 12/1936 | Meeker |
| 2,069,090 | A | | 1/1937 | Hawkinson |
| 3,079,459 | A | | 2/1963 | Abbott |
| 3,363,221 | A | * | 1/1968 | Stark |
| 3,628,815 | A | * | 12/1971 | Louis |
| 3,786,173 | A | | 1/1974 | Vogt |
| 4,070,543 | A | | 1/1978 | Thompson et al. |
| 4,141,619 | A | * | 2/1979 | DeLuca |
| 4,204,739 | A | | 5/1980 | Shoenleben |
| 4,720,275 | A | | 1/1988 | Swart et al. |
| 4,773,725 | A | * | 9/1988 | Ashman et al. |
| 4,874,909 | A | | 10/1989 | Velke, Sr. et al. |
| 5,228,875 | A | | 7/1993 | Swenson, Sr. |
| 5,502,280 | A | | 3/1996 | Rocci et al. |
| 5,542,861 | A | | 8/1996 | Anhalt et al. |
| 5,695,369 | A | * | 12/1997 | Swenson, Sr. ..... 439/784 |
| 5,756,972 | A | * | 5/1998 | Vranicar et al. |
| 5,925,898 | A | | 7/1999 | Späth |
| 6,091,694 | A | | 7/2000 | Späth |

* cited by examiner

*Primary Examiner*—Renee Luebke
*Assistant Examiner*—Phuong Nguyen
(74) *Attorney, Agent, or Firm*—Jim Zegeer

(57) ABSTRACT

A no-crimp electrical connector is essentially comprised of two molded plastic body members. A molded plastic body member has a connection chamber and a threaded wall bounds the connection chamber. A second molded body member has an externally threaded surface threadably engageable with the threaded wall in the first body member. One of the body members has a central conically shaped conductive element, and the other has a throughbore with the throughbore having one end shaped to accommodate two or more wires in side-by-side relation. A second end has complementary conical walls so that the wire ends of the two or more wires are clamped together between the conductive conical shaped element and the conical surface. Slots are provided in one or both body members and form spring fingers to allow pressing and/or relative rotation between the body members.

14 Claims, 3 Drawing Sheets

NO-CRIMP ELECTRICAL CONNECTOR SIDE-BY-SIDE TYPE AND METHOD

REFERENCE TO RELATED APPLICATION

The present application is a continuation-in-part application of application Ser. No. 09/617,231 filed Jul. 14, 2000 entitled NO-CRIMP ELECTRICAL CONNECTOR SIDE-BY-SIDE TYPE, and claims the benefit of provisional application No. 60/146,344, filed Aug. 2, 1999.

BACKGROUND AND BRIEF DESCRIPTION OF THE INVENTION

This invention is an improvement on the QUICK MULTIPLE ELECTRICAL CONNECTOR disclosed in Swenson U.S. Pat. No. 5,695,369 and Swenson U.S. Pat. No. 5,228,875. In the above-referenced Swenson patents, one or more connection chambers has mounted therein a shaped conductive member projecting into the connection chamber and a threaded surface associated therewith. A coacting clamping member is associated with the connection chamber and each clamping member has a threaded portion which is threadably engageable with the threaded surface of the connection chamber and has a complementary tapered surface which is complementary to the tapered surface on the conductive member. Stranded conductive wires are passed through the hollow clamping member and splayed on the conical or taper-shaped surface of the metal conductor. The relative rotation between the housing member and the clamping member causes the threads to reduce the distance and clamp the bare ends of the splayed wire between the conical surfaces.

A molded plastic first body member has a connection chamber and a threaded wall bounding the connection chamber. A second molded plastic second body member has an externally threaded surface threadably engageable with the threaded wall in the first body member. One of the body members has a central conically shaped element having an axis coaxial with the body member in which it is formed. In a preferred embodiment, the conical member has an electrically conductive surface. The second body member has a throughbore with the throughbore having first and second ends. The first throughbore end is shaped to accommodate two or more wires in parallel, side-by-side relation. The second end of the throughbore has conical walls which are complementary to the conical shape of the conductive central conical element so that the wire ends of the two or more wires, preferably twisted together, are clamped together between the throughbore conical walls and the conductive conical surface when the threadably engaged surfaces are rotated relative to each other to move the central conductive conical shaped element and the conical surfaces towards each other, respectively.

Thus, an object of the invention is to provide an improved no-crimp electrical connector and method for connecting stranded electrical wires to each other. Lower gauge solid wires may also be connected using the invention.

DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
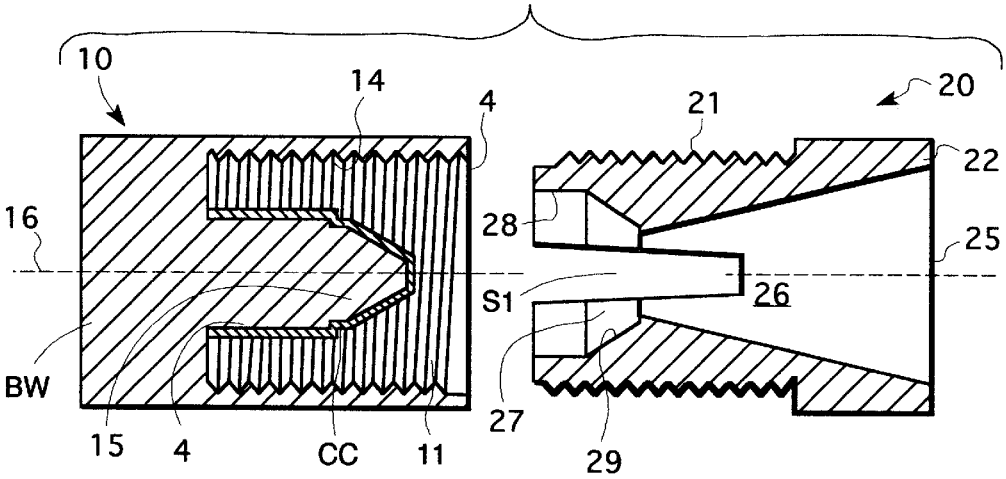
FIG. 1 is a sectional view of a no-crimp connector incorporating the invention.
Figure 2:
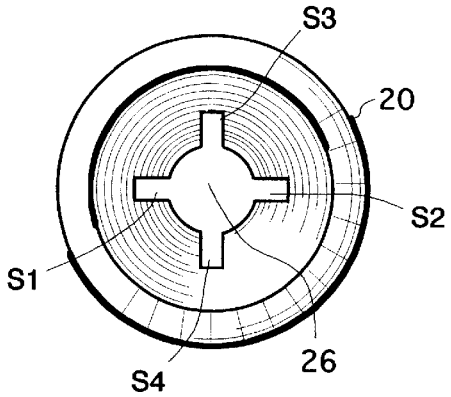
FIG. 2 is an end view of the connector shown in FIG. 1.

Referring to FIG. 1, a cup-shaped female body member 10 has a connection chamber 11 with an internally threaded wall 14 bounding the connection chamber 11. Female body member 10 is of molded plastic and has a central conical element or projection 15 having an axis 16 coaxial with the female body member 10. Shank 14 positions or spaces the conical shaped element in chamber 11. The female body member 10 as illustrated as cup-shaped, and in this preferred embodiment, a conductive coating CC is applied over the central conically shaped element or projection 15 so that the surface at least of the projection 15 is conductive. It will be noted also that the conductive portion CC is totally enclosed within connection chamber 11 and that there is no conductive portion extending beyond the bottom wall BW of the female member 10.

Figure 3:
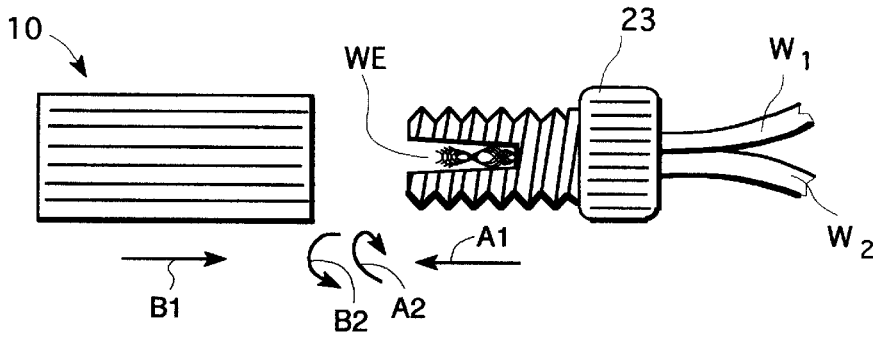
FIG. 3 is a side elevation view showing the connector of FIG. 1 with two wires being connected together, the two wires are then stripped and twisted together before inserting into a male end.

A male body member 20 has an externally threaded surface 21 and a grasping portion 22 which may be knurled as at 23 (FIG. 3). The male member 20 has a throughbore 25 with first and second ends 26, 27. Throughbore end 26 is adapted to receive two or more wires as shown in FIG. 3 with the ends WE twisted together as indicated is FIG. 3.

Throughbore end 27 has a short straight section 28 and a conical surface section 29 which is complementary shaped to the conical shape on end 15 of central projection shank 14.

Male member 20 is provided with a plurality of slots S1, S2, S3, S4 to form a plurality of fingers on the male member 20 so as to allow bending of the fingers when it is pressed into the female housing 10. In this embodiment, when the female member 20 is pressed in the direction of arrow A1, it can be given a slight twist as indicated by arrow A2 after it is seated in the female member 10 so as to use the threaded surfaces as cams to tighten the clamping force on the wire ends WE that have been clamped between the two conical surfaces. An advantage of this construction is that in the event two wires of the same gauge are inserted without being twisted, the conductive contact will still be made if they are both clamped on the conductive coating CC.

In operation, two or more insulated wires W1, W2 . . . WN have their ends stripped of insulation and then twisted together as indicated at WE and inserted through the throughbore end 26. Conical end 15 serves as a splaying surface. The threaded portion 14 of the female member 10 may be threadably engaged with externally threaded portions of the male member 20 before or after insertion of the twisted wire ends WE. The twisted wire ends enter or are splayed into a space between the conductor material CC on conical surface 15 and conical surface 29 and, as the threaded members are pushed together (arrows A1 and B1) and then twisted relative to each other (by thumb and forefinger (arrows A2, B2)), the surface 29 and conical surface 15 move toward each other to thereby clamp together the wire ends WE of the two or more wires to maintain a tight electrical contact and to prevent them from being pulled apart. One or both conical surfaces may have ribs to deform the wire and enhance the pull strength.

Figure 4:
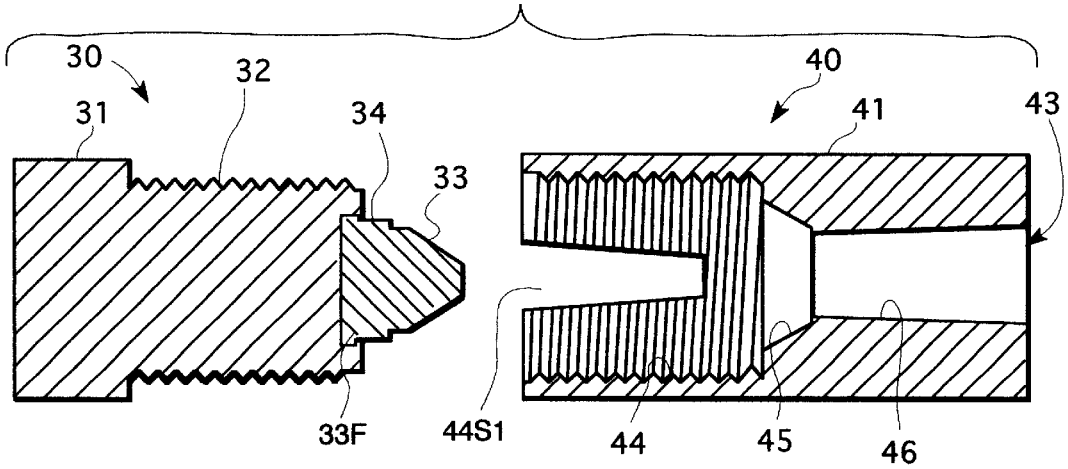
FIG. 4 is a sectional view of a further embodiment of the invention.
Figure 5:
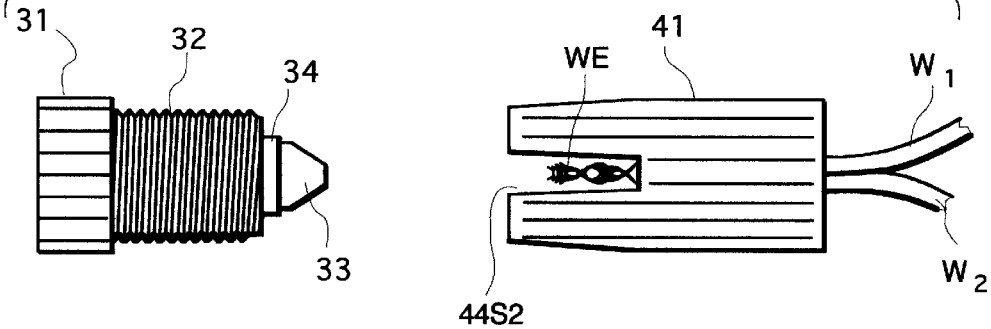
FIG. 5 is a side elevational view of the embodiment of FIG. 4 for joining two or more wires which have been stripped and twisted together before entering into the female end.

In the embodiment shown in FIG. 4, the male body member 30 with a gripping portion 31, which is knurled or roughened (or provided with wingnuts like projections) to prevent slippage in the finger, see FIG. 6, and an externally threaded portion 32 leading to a conically or bullet-shaped conductive protuberance 33 which serves as a splaying surface and has a circular base 34.

Conductive element 33 has a flange 33F which is used to lock the conductive bullet 33 in its mounting on the threaded projection 32.

In this case, female member 40 is provided with a plurality of slots or grooves 44-S1, 44-S2 . . . 44-SN which allow the bending outwardly of the remaining when it pressed onto the threaded male member 32. Like, as before, this allows to make the connection fast and more speedy and, like the earlier embodiment, when the male member 40 is pressed home, it can be given a short twist to tighten the clamping force on the twisted wire ends WE.

Female body member 40 has an externally knurled surface 41 and a throughbore 42. Throughbore bore 42 has three sections:

A threaded internal wall section 44 which is threadably engageable with threaded section 32 on male member 30, a conical shaped section 45 which is complementary to conical or bullet-shaped member 33 and serves to define a wire clamping space therebetween, and a section 46 for receiving two or more wires W1, W2 which have an end stripped to expose bare wire ends WE which have been twisted together and inserted in the throughbore 43 via the end 46.

In use, the wires W1, W2 with their twisted ends WE may be inserted into the female member 40 prior to or after threaded engagement of the male member threads 32 with the female member threads 44 or they may be inserted after the threaded engagement of male member threads 32 with female member threads 44. At any rate, a space is formed between conical surfaces 33 and 45 into which the conical end 33 is splayed to one side. Relative rotation between the male and female body members causes a strong clamping of the wire ends between the conical surfaces 33 and 45.

Figure 6A:
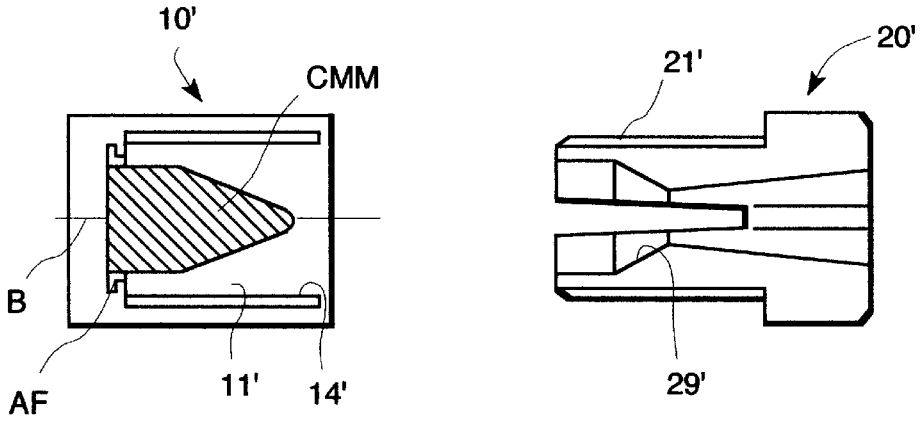
FIGS. 6A, 6B and 6C are sectional views, respectively, or further embodiments of the invention.
Figure 6B:
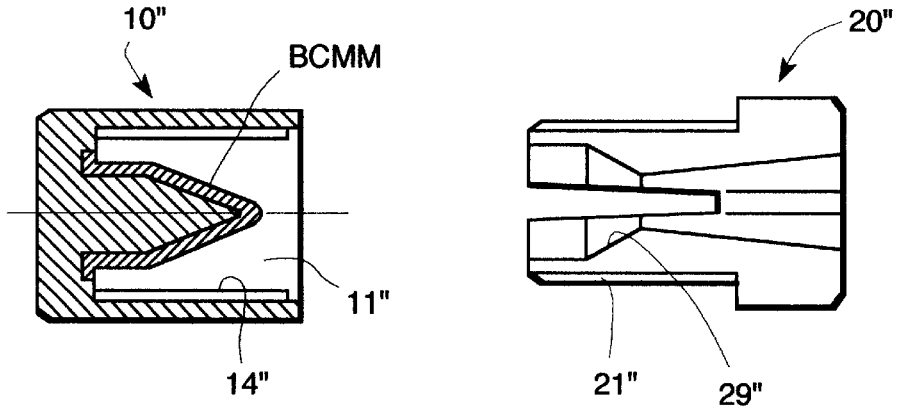
Figure 6C:
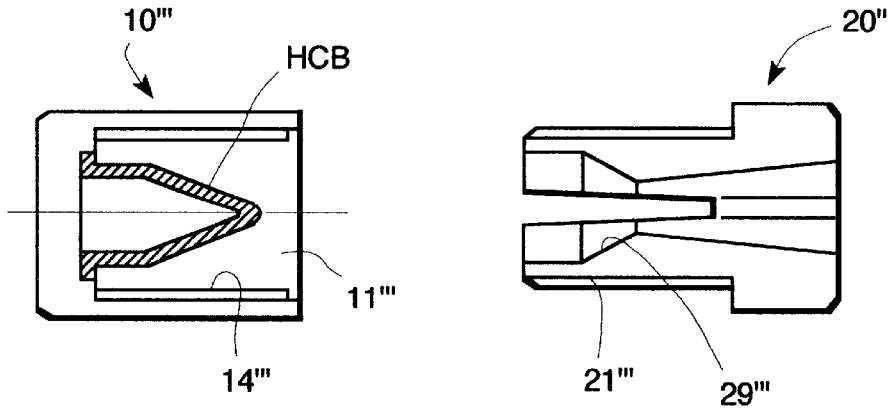

Referring now to the embodiments shown in FIGS. 6A, 6B and 6C, the female member 10' is essentially the same as the female member 10 shown in FIG. 1 having a threaded connection chamber 6-11 and a conductive metal member CMM which is an insert added during the molding process so that the bullet is metal. Annular flange AF is engulfed with plastic (nylon) to lock conductive member CMM in place. The construction of the externally threaded male member 20' is grooved or slotted in a manner disclosed in the earlier embodiment to allow bending of the groove fingers when it is pressed (or screwed) into the female member 10'. It will be noted that the female member 10' is cup-shaped and that there is no conductive portions of the conductive element passing through the base B of the female member 10'.

In the embodiment shown in FIG. 6B, the conductive element BCMM is fitted with plastic to hold it in place in cup-shaped female member 10".

In the embodiment shown in FIG. 6C, a hollow conductive bullet or shell HCB having a flange HCBF, which is molded in the base of the internally threaded cup-shaped housing 10'". The male member 20" is of identical construction and operates in essentially the same way as described earlier.

While the invention has been described in relation to preferred embodiments of the invention, it will be appreciated that other embodiments, adaptations and modifications of the invention will be apparent to those skilled in the art.

What is claimed is:

1. A wire connector for connecting the ends of two or more side-by-side wires together without tools, comprising:

a non-conductive female body member, said female body member having a connection chamber and a threaded internal wall bounding said connection chamber, a non-conductive male body member having an externally threaded surface threadably engageable with said threaded wall on said female body member, one of said body members having a central conically shaped element having an axis coaxial with said one of said body members, said central conically shaped element having a conductive surface thereon, the other one of said body members having a throughbore with first and second ends, said first end being sized to accommodate said two or more wires in side-by-side relation, said second end having a conical wall which is complementary to the conical shape of said conically shaped element so that said wire ends of said two or more wires are clamped together in electrical contact between said conically shaped element and said conical wall.

2. The wire connector defined in claim 1 wherein said conductive surface is a solid metal member.

3. The wire connector defined in claim 1 wherein said conductive surface is on a hollow metal member.

4. The wire connector defined in claim 1 wherein said conductive surface is a conductive shell having an annular locking flange.

5. The wire connector defined in claim 1 wherein at least one of said threaded members is slotted along the length thereof to form spring fingers to allow bending thereof when it is pressed into said threaded female member.

6. A no-crimp electrical connector of the side-by-side type wherein the bare ends of two or more wires are connected without tools comprising:

a non-conductive female body member having a connection chamber and a threaded wall bounding said connection chamber, a non-conductive male body member having an externally threaded surface threadably engageable with the threaded wall on the female body member and slots along the length thereof, one of said body members having a conductive conically shaped element mounted coaxially with said one of said body members, the other of said body members having a throughbore, said throughbore having first and second ends, said first end being sized to accommodate two or more wires in side-by-side relation, said second end having a conical wall which is complementary in shape to the conical shape of said conductive conically shaped element, whereby connection of said two or more wires can be made by stripping said wire ends of insulation and twisting said wire ends together, inserting said twisted wire ends in said first end of said throughbore and rotating threadably engaged first and second body together so that said two or more wire ends are clamped together between said conductive conical surface on said conically shaped element and said conical surface on said throughbore.

7. A two-part, no-crimp electrical connector for connecting the bare ends of two or more insulated wires together in side-by-side relation comprising:

a molded cup-shaped plastic body member having a connection chamber and a threaded wall bounding said connection chamber, said molded plastic first body member having a conically shaped element with an axis coaxial with said connection chamber and a conductive surface only on said conically shaped element, a second molded plastic body member having an externally threaded surface threadably engageable with said threaded wall in said first body member, said second body member having a throughbore, said throughbore having first and second ends, the first of said ends being sized to accommodate two or more wires in parallel side-by-side relation, and a second end of said throughbore having a conical wall which is complementary to the conical shape of said conically shaped element so that the bare ends of the two or more insulated wires are clamped together between the conductive surface on said conically shaped element and the conical wall when said threadably engaged surfaces are moved relative to each other to move the central conically shaped element and the conical surface toward each other, respectively.

8. The electrical connector defined in claim 7 wherein at least one of said threaded members is slotted along the length thereof to form spring fingers to allow bending thereof when it is pressed into said threaded female member.

9. A two-part, no-crimp electrical connector for connecting the bare ends of two or more insulated wires together in side-by-side relation, comprising:

a cup-shaped, molded plastic non-conductive female body member having a connection chamber, a threaded wall bounding said connection chamber, an end wall, and conically shaped conductive elements mounted on said end wall and within said connection chamber, a molded plastic male body member having an externally threaded surface threadably engageable with said threaded wall in said first body member, said male body member having a throughbore with a conically shaped surface at one end facing said conically shaped conductive element and a passage for receiving the bare ends of two or more insulated wires.

10. The invention defined in claim 9 wherein said male member has a plurality of slots at said threaded surface to allow bending thereof.

11. The method of connecting the ends of two or more insulated wires together without tools comprising:

providing a female body member having a connection chamber and a threaded wall bounding said connection chamber, a male body member having an externally threaded surface threadably engageable with the threaded wall on the female body member, one of said body members having an element with a conductive conically shaped surface, the other of said body members having a throughbore with first and second ends, said first end being sized to accommodate two or more wires in side-by-side relationship, said second end having a conical wall surface which is complementary to the conical shape of said conically shaped surface, stripping the wire ends and twisting said wire ends together, inserting said twisted-together wire ends in said first end of said throughbore, twisting said threadably engaged first and second body members together so that said two or more wire ends are clamped together and electrical contact between said conically shaped element and said conical surface when said threadably engaged surfaces are rotated relative to each other to move said conically shaped element and said conical surfaces toward each other, respectively.

12. The method defined in claim 11 wherein said wires are of the same wire gauge size.

13. The method defined in claim 11 wherein said wires are stranded wires.

14. The method defined in claim 11 wherein said male body member has a plurality of slots therein and prior to twisting, the step of pressing said members together and then performing said twisting.

* * * * *